US006721650B2

(12) United States Patent
Fushiki et al.

(10) Patent No.: US 6,721,650 B2
(45) Date of Patent: Apr. 13, 2004

(54) METHOD OF PRESUMING TRAFFIC CONDITIONS BY USING FLOATING CAR DATA AND SYSTEM FOR PRESUMING AND PRESENTING TRAFFIC CONDITIONS BY USING FLOATING DATA

(75) Inventors: Takumi Fushiki, Hitachi (JP); Kenichiro Yamane, Hitachi (JP); Takeshi Inoue, Hitachi (JP); Takayoshi Yokota, Hitachiota (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/372,827

(22) Filed: Feb. 26, 2003

(65) Prior Publication Data

US 2003/0125874 A1 Jul. 3, 2003

Related U.S. Application Data

(63) Continuation of application No. 09/956,090, filed on Sep. 20, 2001, now Pat. No. 6,546,330.

(30) Foreign Application Priority Data

Feb. 23, 2001 (JP) ..... 2001-049303

(51) Int. Cl.[7] ..... G06G 7/70
(52) U.S. Cl. ..... 701/118; 701/119
(58) Field of Search ..... 701/118, 119, 701/24, 117, 200, 213, 215; 342/454, 461; 246/167 R, 187 C; 340/932, 903, 905, 934, 910, 995; 455/456

(56) References Cited

U.S. PATENT DOCUMENTS

| | | | | | |
|---|---|---|---|---|---|
| 6,061,625 | A | * | 5/2000 | Fastenrath | 701/117 |
| 6,178,374 | B1 | * | 1/2001 | Mohlenkamp et al. | 701/117 |
| 6,470,262 | B2 | * | 10/2002 | Kerner et al. | 701/117 |
| 6,505,117 | B1 | * | 1/2003 | Ratert et al. | 701/209 |
| 2001/0029425 | A1 | * | 10/2001 | Myr | 701/200 |
| 2002/0026277 | A1 | * | 2/2002 | Kerner et al. | 701/117 |

FOREIGN PATENT DOCUMENTS

| | | |
|---|---|---|
| JP | 7-029098 | 1/1995 |

* cited by examiner

*Primary Examiner*—Thomas G. Black
*Assistant Examiner*—Ronnie Mancho
(74) *Attorney, Agent, or Firm*—Kenyon & Kenyon

(57) ABSTRACT

A method of presuming traffic conditions for implementing a forecast and a presumption of traffic jam situation in an area where probe cars are not traveling currently, in which the probe cars send floating car data that is times and positions of traveled areas to center facilities, and the center accumulates the floating car data in a floating car data database by traffic conditions presumption means and also presumes forecast traffic jam information in the forward areas of the probe cars and presumed traffic jam information in the backward areas thereof by using the current floating car data and the floating car data database accumulated from the past to the present.

11 Claims, 11 Drawing Sheets

VEHICLE ID = 0001

| INFORMATION ID | TIME | POSITION | DIRECTION | SPEED | SPEED AVERAGE | SPEED LAST INFORMATION ID |
|---|---|---|---|---|---|---|
| 0013 | 2000/12/07 19:24:15 | 139° 11'11.1"E 35° 11'11.1"N | 250° | 20km/h | 15.5km/h | 0012 |
| 0014 | 2000/12/07 19:24:25 | 139° 22'22.2"E 35° 22'22.2"N | 240° | 0km/h | 5.5km/h | 0013 |
| 0015 | 2000/12/07 19:24:35 | 139° 22'22.2"E 35° 22'22.2"N | 230° | 0km/h | 0.0km/h | 0014 |
| 0016 | 2000/12/07 19:40:14 | 139° 22'22.2"E 35° 22'22.2"N | 110° | 0km/h | 0.0km/h | 0000 |
| 0017 | 2000/12/07 | 139° 33'33.3"E | 120° | 40km/h | 20.0km/h | 0016 |

FIG. 5

| | 501 | 502 | 503 | 504 | 505 | 506 | |
|---|---|---|---|---|---|---|---|
| | CURRENT DRIVING PATH | PAST DRIVING PATH 1 | PAST DRIVING PATH 2 | . . | PAST DRIVING PATH N | FORECAST DRIVING PATH | |
| DISTANCE [m] | LOCATION SPEED [km/h] | | | | | | RELIABILITY |
| 0 | 50 | – | 55 | | 56 | 50 | 100 |
| 10 | 51 | – | 56 | | 60 | 51 | 100 |
| 20 | 55 | – | 60 | | 62 | 55 | 100 |
| 30 | 56 | – | 62 | | 60 | 56 | 100 |
| : | : | : | : | | : | : | : |
| 100 | 50 | 30 | 40 | | 44 | 50 | 100 |
| 110 | 48 | 33 | 42 | | 43 | 48 | 100 |
| 120 | 49 | 35 | 45 | | 42 | 49 | 100 |
| : | : | : | : | | : | : | : |
| 480 | 35 | 15 | 9 | | 40 | 35 | 100 |
| 490 | 32 | 20 | 5 | | 42 | 32 | 100 |
| 500 | – | 15 | 9 | | 30 | 26 | 95 |
| 510 | – | 20 | 5 | | 35 | 28 | 95 |
| 520 | – | 23 | 10 | | 32 | 25 | 90 |
| 530 | – | 25 | 12 | | 26 | 25 | 90 |
| 540 | – | 26 | 13 | | 25 | 25 | 85 |
| : | : | : | : | | : | : | : |
| 1160 | – | 35 | 40 | | 50 | 40 | 40 |
| 1170 | – | 39 | 42 | | 55 | 45 | 35 |
| 1180 | – | 40 | 45 | | 56 | 43 | 35 |
| 1190 | – | 41 | 50 | | 60 | 50 | 30 |

FIG. 7

| ROUTE ID | STARTING POSITION | ENDING POSITION | AVERAGE SPEED | REQUIRED TIME | SITUATION | RELIABILITY |
|---|---|---|---|---|---|---|
| 0001 | 139° 11'11.1"E 35° 11'11.1"N | 139° 22'11.1"E 35° 22'11.1"N | 20km/h | 134 SEC | CONGESTED | 80 |
| 0001 | 139° 22'11.1"E 35° 22'11.1"N | 139° 22'22.2"E 35° 22'22.2"N | 40km/h | 450 SEC | SMOOTH | 100 |
| 0001 | 139° 22'22.2"E 35° 22'22.2"N | 139° 22'33.2"E 35° 22'33.2"N | 10km/h | 643 SEC | JAM | 75 |
| 0002 | 139° 22'33.2"E 35° 22'33.2"N | 139° 22'44.2"E 35° 22'44.2"N | – | – | UNCLEAR | 0 |
| 0002 | 139° 22'44.2"E | 139° 33'33.3"E | 40km/h | 370 SEC | SMOOTH | 90 |

117

METHOD OF PRESUMING TRAFFIC CONDITIONS BY USING FLOATING CAR DATA AND SYSTEM FOR PRESUMING AND PRESENTING TRAFFIC CONDITIONS BY USING FLOATING DATA

CROSS REFERENCES TO RELATED APPLICATIONS

This is a continuation of application Ser. No. 09/956,090 filed Sep. 20, 2001 now U.S. Pat. No. 6,546,330.

FIELD OF THE INVENTION

The present invention relates to a method of presuming traffic conditions by using floating car data and a system for presuming and presenting traffic conditions by using floating car data, and in particular, to the method of presuming traffic conditions, an on-vehicle terminal and the system for presuming and presenting traffic conditions by using positional information gathered by a movable body.

Moreover, this specification defines as the floating car data two kinds of information, that is, time information and positional information in a passing route gathered by the movable body. In addition, the movable body currently gathering the floating car data is defined as a probe car.

BACKGROUND OF THE INVENTION

As for a method of gathering traffic jam information of a driving section by using positional information (=floating car data) gathered by a vehicle, the method of acquiring it by receiving at a base speed information and vehicle location information sent from the vehicle and statistically computing it at the base as in JP-A-7-29098 is known.

The method of presuming traffic jam situation by using the floating car data has a problem that, if the traffic jam situation is presumed just by using the current floating car data just as in the conventional technology in a stage where a diffusion rate of floating car data gathering terminals is low, an area capable of presenting traffic jam situation is limited to the area where the movable body gathering the floating car data is currently traveling.

SUMMARY OF THE INVENTION

Therefore, an object of the present invention is to provide a method of presuming traffic conditions by which a probe car implements a forecast and a presumption of traffic jam situation in an area where it is not traveling currently.

Another object of the present invention is to provide a system for presuming and presenting traffic conditions and an on-vehicle terminal for forecasting the traffic jam situation as required by a driver by using the floating car data and surrounding traffic conditions.

A further object of the present invention is to provide a system for presuming and presenting traffic conditions by using floating car data allowing a user of the system to determine reliability of the presented traffic conditions by notifying the reliability of the presented traffic jam situation together with the traffic jam situation.

To attain the above objects, the method of presuming traffic conditions of the present invention is characterized by forecasting the traffic jam situation in a forward section of the probe car by using the floating car data and a group of floating car data accumulated from the past to the present.

In addition, the method of presuming traffic conditions of the present invention is characterized by presuming the traffic jam situation in the sections from backward to forward around the probe car by using the floating car data.

Use of the method of presuming traffic conditions of the present invention allows the probe car to implement forecasts and presumptions of traffic jam situation in an area where it is not traveling currently.

Furthermore, the on-vehicle terminal of the present invention has communication means for receiving surrounding traffic conditions from the center facili-ties, and also has traffic conditions presumption means for forecasting the traffic jam situation in the forward section of its vehicle by using the traffic information and the floating car data gathered by its own vehicle.

In addition, a system for presuming and presenting traffic conditions of the present invention is characterized by presuming the traffic jam situation, calculating reliability in the section of which traffic jam situation is presumed and also presenting to the user the presumed traffic jam situation and reliability as traffic conditions.

Use of the system for presuming and presenting traffic conditions and the on-vehicle terminal of the present invention allows the traffic jam situation to be forecasted and presented according to a driver's individual necessity. Moreover, use of the system for presuming and presenting traffic conditions of the present invention allows the user of the system to determine reliability of the presented traffic conditions by notifying the reliability of the presented traffic jam situation together with the traffic jam situation.

Use of the method of presuming traffic conditions of the present invention allows the probe car to implement forecasts and presumptions of traffic jam situation in an area where it is not traveling currently.

Moreover, use of system for presuming and presenting traffic conditions and the on-vehicle terminal of the present invention allows the traffic jam situation to be forecasted and presented according to the driver's individual necessity.

Furthermore, use of the system for presuming and presenting traffic conditions of the present invention allows the user of the system to determine reliability of the presented traffic conditions by notifying the reliability of the presented traffic jam situation together with the traffic jam situation.

BRIEF DESCRIPTION OF THE DRAWINGS

FIG. 5 is a format of a driving path in the forward forecast process;

FIG. 7 is a format of presented traffic jam information;

DETAILED DESCRIPTION OF THE INVENTION

Figures 2, 3:
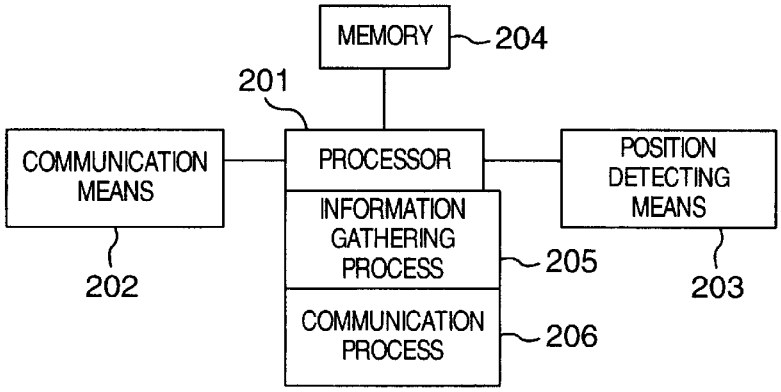
FIG. 2 is an on-vehicle terminal mounted on a probe car in the embodiment in FIG. 1.
FIG. 3 is a format of a floating car data database in the embodiment in FIG. 1.

Floating car data handled in the present invention is information including time and positions measured by a vehicle running on a real road network. An Apparatus for gathering traffic jam information by using the floating car data is known as in JP-A-7-29098 for instance. In addition, the present invention defines as a probe car a vehicle for gathering the floating car data by running on the real road network. The probe car is sufficient if it has means for gathering the floating car data as shown in FIG. 2. For instance, a vehicle on which a navigation system equipped with means for recording and communicating the floating car data is mounted or a vehicle carrying a portable telephone capable of specifying positional information are also included as the probe car.

A first embodiment of the present invention shows a method of presuming the traffic jam situation regarding an area where the probe car is not traveling currently by compiling a plurality of the floating car data, a method of presenting the traffic jam situation, and a system for presuming and presenting traffic conditions for presuming and presenting the traffic jam situation. The first embodiment of the present in-vention will be described according to the drawings.

[First Embodiment]

Figure 1:
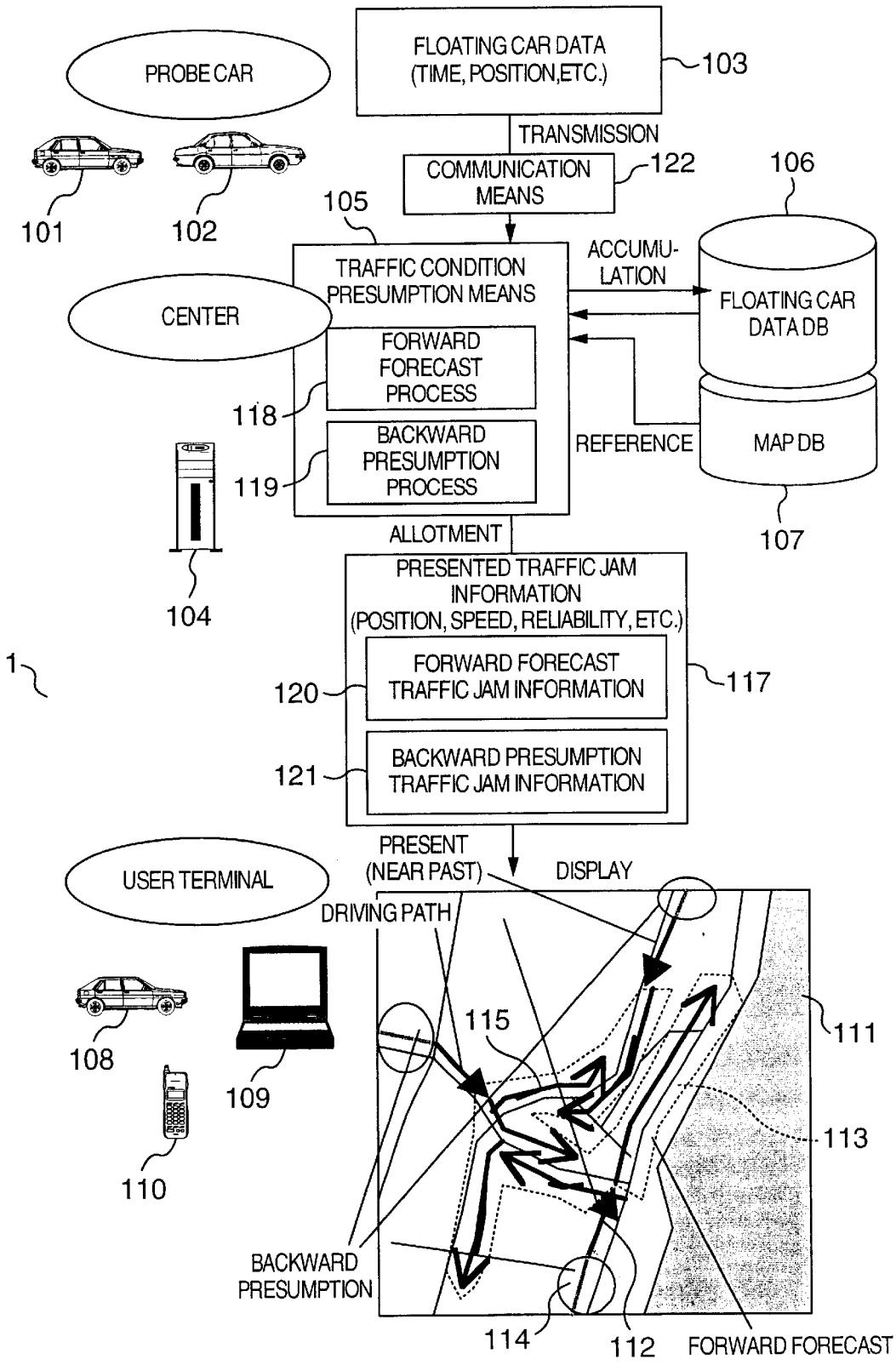
FIG. 1 is an example of a system for presuming and presenting traffic conditions by using floating car data according to a first embodiment.

FIG. 1 is a schematic diagram of a system for presuming traffic conditions by using floating car data and presenting the traffic conditions according to the first embodiment of the present invention. Reference numeral 1 denotes a system for presuming and presenting traffic conditions by using floating car data, reference numerals 101 and 102 denote probe cars for gathering the floating car data, reference numeral 104 denotes center equipment having traffic conditions presumption means 105 and a floating car data database (hereafter, abbreviated as DB) 106 and a map DB 107, reference numerals 108, 109 and 110 denote user terminals for receiving traffic information presentation service, that is, reference numeral 108 denotes a vehicle having an on-vehicle terminal equipped with traffic information receiving means, reference numeral 109 denotes a personal digital assistant (hereafter, abbreviated as PDA), and reference numeral 110 denotes a portable telephone terminal. The user terminals 108, 109 and 110 are capable of displaying a traffic information map indicated by 111. The center has communication means 122, and the probe cars and the center are connected by a mobile communication network and are capable of radio data communication by line switching or packet trans-mission. In addition, the center and the user terminals are connected by a network (including a broadcast) or the Internet and are capable of communication.

A process of gathering and compiling the floating car data and presenting the traffic information in the system in FIG. 1 will be described according to the flow of information. The probe cars 101 and 102 gather floating car data 103 on a real road network, and sends it to the center equipment 104. The center equipment 104 accumulates the received floating car data in the floating car data DB 106. By accumulating the floating car data, the floating car data DB 106 becomes a real driving path database in a wide area. Furthermore, the center equipment 104 refers to a floating car data group in the floating car data DB 106 and the map DB 107 to create presented traffic jam information 117 by using a forward forecast process 118 and a backward presumption process 119 in the traffic conditions presumption means 105.

The user terminals 108, 109 and 110 acquire the presented traffic jam information 117 from the center equipment 104 and display the traffic information map 111. The traffic information map 111 is a representation of the traffic information of the presented traffic jam information 117 on a map. On the traffic information map 111, a group of lines indicated by an arrow 112 represents the driving path on which the probe cars actually traveled in the near past (for instance, a time period from 5 minutes ago to the present), and is defined as a current driving path. The arrow included in a dotted-line area 113 represents the driving path on which the probe cars are highly likely to travel, and is defined as a forward forecast. A section included in a circular area 114 represents current traffic jam situation in the section on which the probe cars actually traveled before the near past (for instance, a time period from 10 minutes ago to 5 minutes ago), and is defined as a backward presumption.

A current driving path 112, a forward forecast 113 and a backward presumption 114 are displayed as color-coded based on the speed in the presented traffic jam information 117 respectively. As indicated by 115 for instance, a section satisfying a fixed speed range (for instance, 0 km per hour to 15 km per hour) is displayed as color-coded as a traffic jam section. In addition, a section satisfying a speed range that is not enough to be a traffic jam but hardly smooth (for instance, 15 km per hour to 30 km per hour) is displayed as color-coded as a congested section. Moreover, the current driving path 112, forward forecast 113 and backward presumption 114 change their display methods based on reliability in the presented traffic jam information 117 respectively. For instance, there are methods such as rendering the color lighter or switching to flashing indication according to the reliability.

Utilization of the system for presuming and presenting traffic conditions of the present invention allows the probe cars to presume and present traffic jam situation in a section where they are not traveling at the current time.

Hereafter, detailed configuration of the probe cars, the center and the user terminals constituting the system for presuming and presenting traffic conditions shown in FIG. 1, and a processing flow, a data format and so on will be described by using FIG. 2 to FIG. 7 and FIG. 9 to FIG. 12.

FIG. 2 is a block diagram of the on-vehicle terminal mounted on the probe cars. Reference numeral 201 denotes a processor for executing an information gathering process 205 and a communication process 206, reference numeral 202 denotes communication means for sending the floating car data to the center, reference numeral 203 denotes position detecting means for detecting positions of the probe cars, and reference numeral 204 denotes a memory for storing the floating car data. The processor 201 records by the information gathering process 205 the positions of the probe cars measured by position detecting means 203 such as a GPS (Global Positioning System) in the memory 204 together with the time in each fixed cycle, and sends the floating car data to the center by using a communication process 206 in predetermined timing such as in a fixed cycle, on detection of a traffic jam, and on an instruction from the center.

FIG. 3 is a format of the floating car data DB 106 accumulated at the center in FIG. 1. The center accumulates the floating car data on the time and position sent by the probe cars together with the direction, speed and average speed. Here, as the method of calculating the average speed, a moving average of speeds calculated and sent to the center on the part of the probe cars, a calculation made along the driving path on the part of the center by using the times and positions gathered on the part of the map DB 107 and the probe cars, or the speeds gathered on the part of the probe cars and averaged on the part of the center and so on are thinkable for instance. The above methods of calculation may vary depending on throughput and function sharing on the part of the probe cars and on the part of the center.

Figure 4:
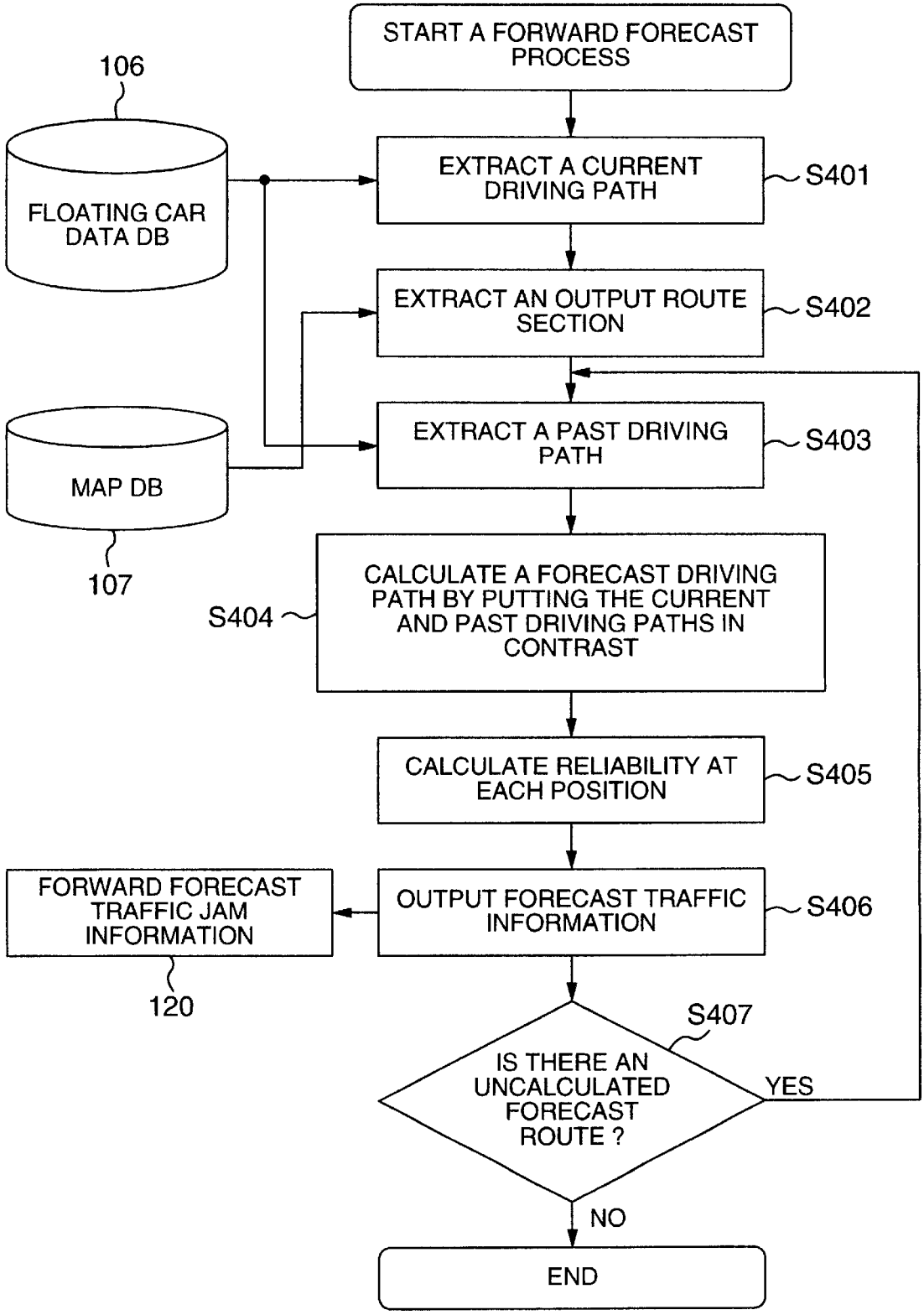
FIG. 4 is a flowchart of a forward forecast process in the embodiment in FIG. 1.

FIG. 4 is a flowchart of the forward forecast process 118 in FIG. 1. The flow of the forward forecast process will be described according to the flowchart. First, the current driving path is extracted from the floating car data DB 106 (S401). Next, the current driving route is calculated by map-matching the extracted current driving path on the road network of the map DB 107, and an output route section for calculating the forward forecast traffic information 118 based on the current driving route is extracted from the road network of the map DB 107. As the output route section, a plurality of routes adjacent to the current driving route on which the probe cars are highly likely to travel from now on will be extracted (S402). Next, the past driving paths on the output route section accumulated in advance are extracted from the floating car data DB 106 (S403). The current driving path and the past driving path extracted in the above process are put in contrast so as to calculate a forecast driving path (S404). In addition, reliability at each position of the forecast driving path is calculated (S405). Detailed description of S404 and S405 is mentioned later by using FIG. 5 and FIG. 6. The forecast driving path calculated in S404 and S405 is converted into a format of the presented traffic jam information as shown in FIG. 7, and forward forecast traffic jam information 120 is outputted (S406). The forward forecast traffic jam information is calculated likewise as to the plurality of routes extracted in S402 (S407).

FIG. 5 represents a format of the driving path in the forward forecast process. The aforementioned current and past driving paths are represented as a location speed at each distance calibration marking (10 m in the example in FIG. 5) with reference to a starting point of the output route section. At a location of a distance where the floating car data exists, the speed or the average speed of the floating car data is used as the location speed. As for a location where the floating car data does not exist, the speed or the average speed of forward and backward floating car data is complemented as the location speed. The location speed at an untraveled location is represented by using—in FIG. 5. As for a future driving path, reliability at each location is calculated in addition to the location speed.

Figure 6:
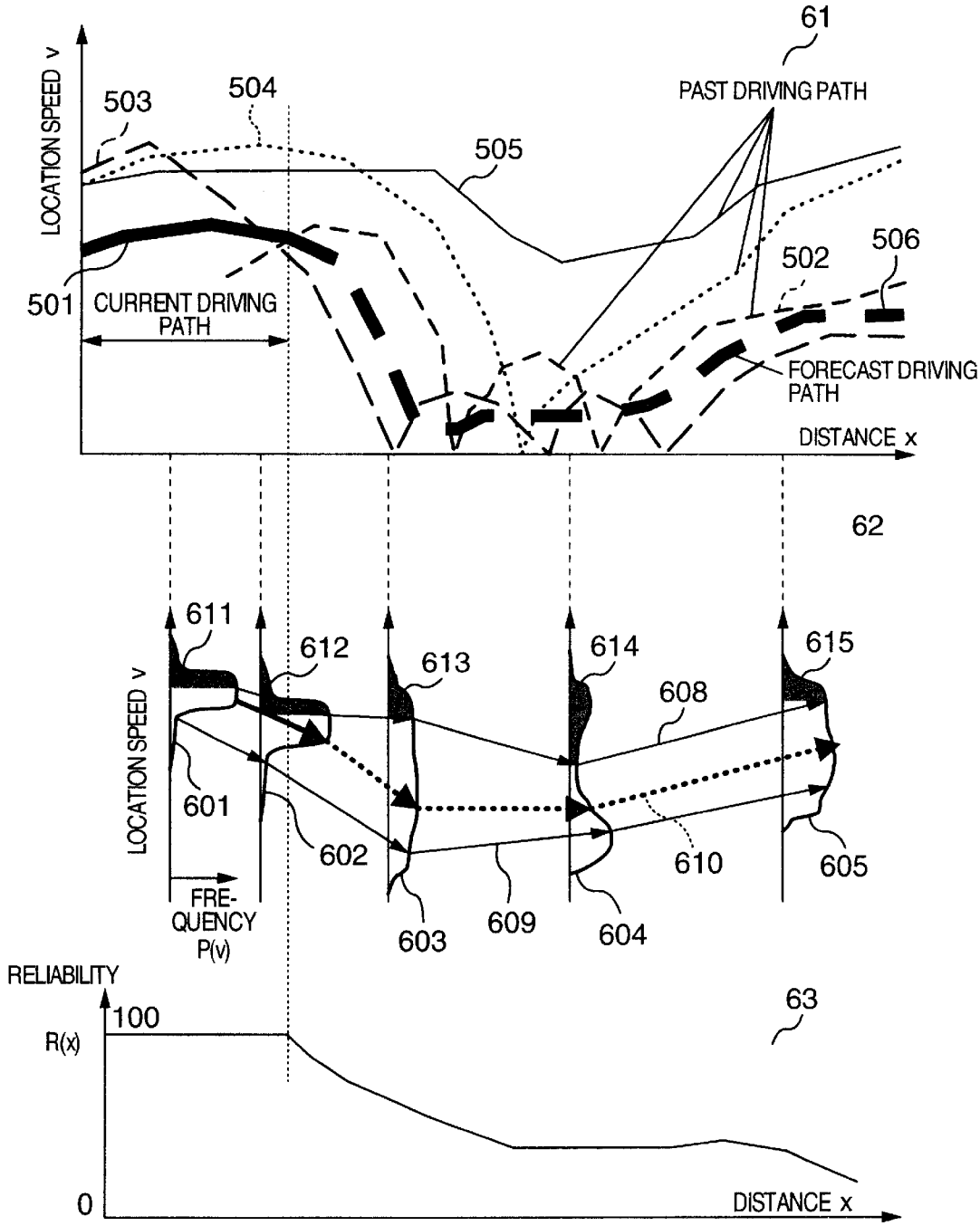
FIG. 6 is a graph describing the forward forecast process of the present invention.

FIG. 6 is a graph of the distance and location speed every driving path (61), a graph of the change of location speed distribution at each location (62), and a graph of the distance and reliability (63). The graph 61 represents the current driving path, a plurality of the past driving paths and the forecast driving path, reference numeral 501 denotes the current driving path, reference numerals 502 to 505 denote the past driving paths, and reference numeral 506 denotes the future driving path. The graph 62 represents the change of location speed distribution corresponding to the horizontal axis distance of the graph 61, and reference numerals 601 to 605 denote location speed distribution at each location by taking frequency P(v) as the horizontal axis. The graph 63 represents the change of reliability R(x) at each location. Hereafter, a method of calculating the forecast driving path (location speed and reliability) will be described by using FIG. 6.

In the graph 61, the driving path as of this point in time is represented by a current driving path 501, and the forward section thereof is a subject section to calculate a forecast driving path 506. First, statistical distribution of the location speeds 601 to 605 is created from the past driving paths 502 to 505. Here, it is assumed that the location speed of a certain past driving path changed as indicated by 607 and 608 in the location speed distribution. In this case, a cumulative frequency of the location speed changes 607 and 608 (equivalent to the respective area of areas 611 to 615 against the speed change 608) in the location speed distribution 601 to 605 is calculated. It is assumed that, the higher the correlation of cumulative frequencies among the locations (such as correlation between 611 and 612) is, the higher the correlation of speed distribution among the locations is, so that the speed in the forward area can be calculated from the speed in the backward area. To be more specific, in the case where the change in the location speed distribution of the current driving path 501 is as indicated by 609, the cumulative frequency at each location (cumulative frequencies in location speed distribution 601 and 602) is calculated. If the correlation between the cumulative frequencies at each location is close to that of the location speed distribution, it is possible to extract the speed in the distribution as a forecast driving path 610 on the assumption that the speed change of the current driving path is in conformity with the change in the location speed distribution. In addition, a reliability function R(x) shown in the graph 63 is established considering the correlation of the speed distribution among the locations so that, the farther it is from the position that the car is currently traveling, the less it becomes. The function R(x) at each location is acquired to calculate the reliability of the forecast driving path at each location.

The method of the backward presumption will be described below by using FIG. 9 and FIG. 10.

Figure 9:
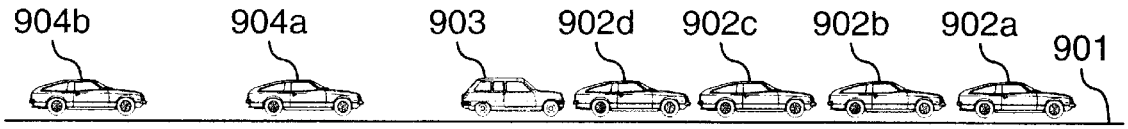
FIG. 9 shows the probe car and traffic jam describing a backward presumption process.

In FIG. 9, reference numeral 901 denotes a bottleneck, reference numeral 902 denotes vehicles in a queue due to the bottleneck 901, reference numeral 903 denotes the probe car, and reference numeral 904 denotes following vehicles. The bottleneck is a road location such as an intersection, a sag, a tunnel or a tollbooth where traffic capacity is drastically reduced compared to an upstream portion, and so the traffic jam is apt to occur toward the upstream as in FIG. 9 when a traffic demand intensifies to an extent.

Figure 10:
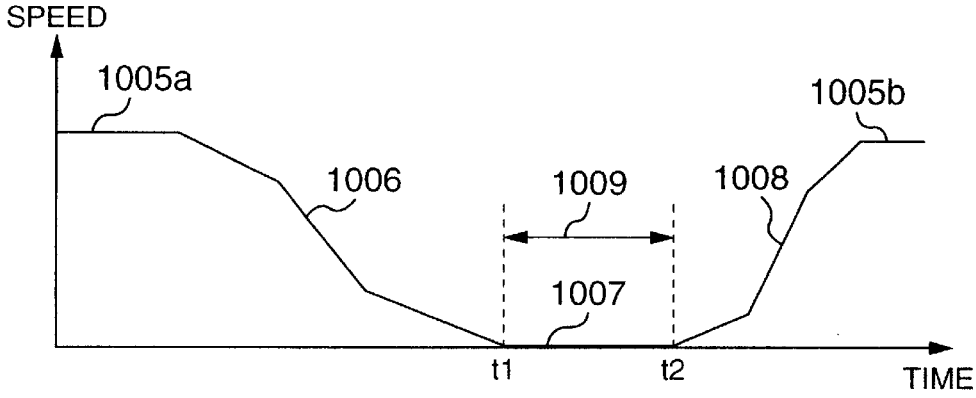
FIG. 10 is an example of speed change measured since the probe car joins a traffic jam queue until it passes through a bottleneck.

FIG. 10 shows an example of speed change measured since the probe car 903 joins a traffic jam queue until it passes through the bottleneck. In FIG. 10, reference numeral 1005 shows a state of traveling at a fixed speed, reference numeral 1006 shows a state of decelerating, reference numeral 1007 shows a state of stopping, and reference numeral 1008 shows a state of accelerating. Reference numeral 1009 that denotes duration of the stopped state 1007 shows stop time tw(=t2−t1). It can be presumed that, if the following vehicles 904 in FIG. 9 join the queue during the stop time tw at an average arrival interval ta, a queue of tw/ta vehicles is added at the back (upstream) of the probe car 903. Furthermore, if an average vehicle distance L (an average of vehicle length and distance between vehicles) when two consecutive vehicles stop is used, it is presumed that the length of the tw/ta queue is L·tw/ta. If these presumption results are used, it is presumed that, in FIG. 9 and FIG. 10, the traffic jam situation at time t1 is a jam headed by the bottleneck 901 and up to the stop position (measured by a GPS or the like) of the probe car 903, and the traffic jam situation at time t2 is a jam headed by the bottleneck 901 and up to the backward position (upstream) L·tw/ta of the probe car 903, and so the changing situation of the traffic jam can be known in real time. Here, the average vehicle distance L at the stop time is a predetermined constant, which is calculated by presumption by using a large vehicle mixing rate or the like or acquired from measurement data such as positional information by two consecutive probe cars. While the average arrival interval ta of the following vehicles can be a predetermined constant, it is better to use real-time measurement information in order to improve accuracy. The following two types of the real-time measurement method are taken up as examples.

(1) In Case of Using Information of a Vehicle Sensor

Figure 11:
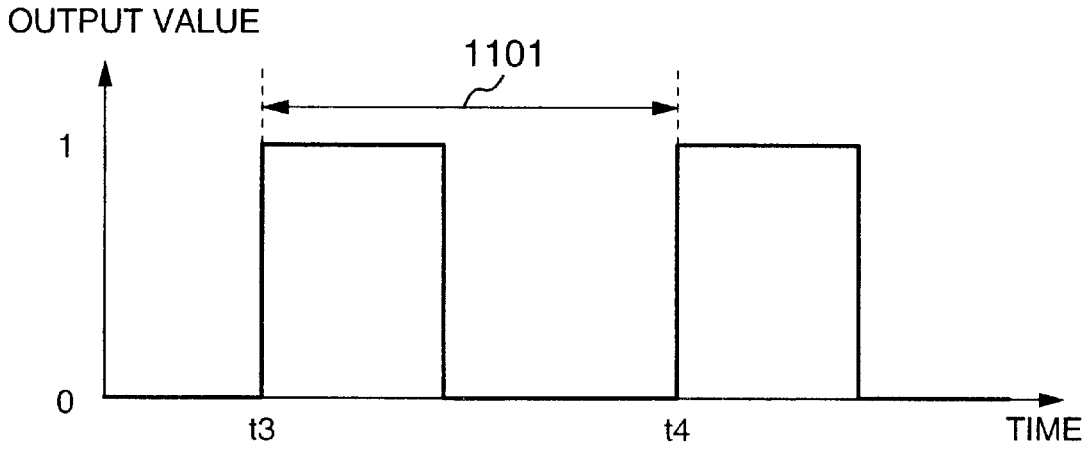
FIG. 11 is an example of measurement data of a vehicle sensor.

In the case where the vehicle sensor is installed in the upstream portion of the bottleneck, the average arrival interval ta can be calculated by using this measurement information. The vehicle sensor is an apparatus installed on a road lane for detecting whether there is a vehicle immediately below it every moment. FIG. 11 shows an example of measurement. FIG. 11 shows that 1 is outputted as an output value while detecting the vehicle and 0 is outputted while detecting none, and two vehicles are detected in this case. According to the measurement results, a time difference 1101 between detection start times t3 and t4 of the two vehicles is equivalent to the average arrival interval ta.

(2) Using Information of an Image Sensor

As the image sensor has a function of detect-ing and tracking vehicles one by one, the average ar-rival interval ta can be calculated from the positional information of the two consecutive vehicles and the vehicle speed acquired from time differential of the information.

In addition, in the case of the above embodiment, the traffic demand per unit time at the upstream portion of the bottleneck is 1/ta since the average arrival interval is ta. On the other hand, if the traffic capacity in the bottleneck per unit time is C, the traffic jam is extended when it is 1/ta>C, and the traffic jam is resolved when it is 1/ta<C. Here, a traffic jam speed v can be represented as follows.

$$v=(1/taC)/k$$

In this case, k is existence density of the vehicle, which can be acquired by the inverse of the above described average vehicle distance L of the stop time in the case where it is stopped due to the traffic jam.

It is indicated that the traffic jam is in an extending direction (upstream) when the traffic jam speed v is a positive value and is in a resolving direction (downstream) when it is a negative value.

Figure 12:
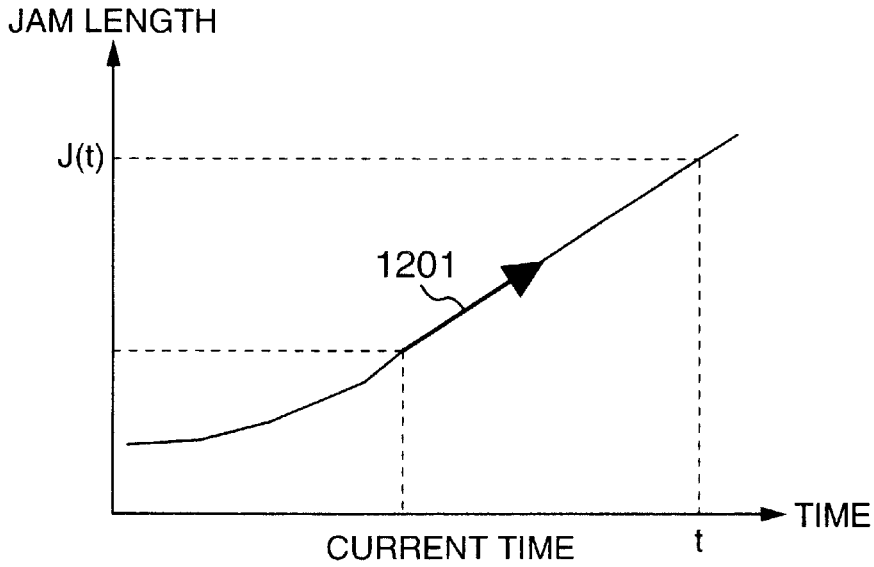
FIG. 12 is a relationship between elapsed time and traffic jam length.

As shown in FIG. 12, it is possible to forecast traffic jam length J(t) at a near future time t from this traffic jam speed v and the above-mentioned real-time changing situation of the traffic jam. While this example is linear prediction of the traffic jam length J(t) at a near future time t from a traffic jam speed 1201 at the current time t, it may be a near-future forecasting method of statistically processing the past traffic jam speeds.

While the average arrival interval ta is determined by the above method, accuracy of the traffic jam information varies depending on how to use it. For instance, presented traffic jam information is created by improving the reliability of the information of which accuracy has been improved by using real-time information.

FIG. 7 is a format of the presented traffic jam information. The forecast driving path calculated by the forward forecast process and the traffic jam situation calculated by the backward forecast process are converted into the format in FIG. 7 and presented to the user terminal. When the user terminal presents the traffic information to the user, the presented traffic jam information is converted into the form of the traffic information map 111 shown in FIG. 1, the form of a simplified map or the form of character information.

It is possible, by using the system for presuming and presenting traffic conditions of the present invention shown in the above examples, to present traffic jam situation in a section where the probe car is not traveling at the current time. At the same time, it is possible for the user of this system to determine the reliability of the presented traffic jam situation on his or her own by calculating and presenting the reliability.

[Second Embodiment]

Figure 8:
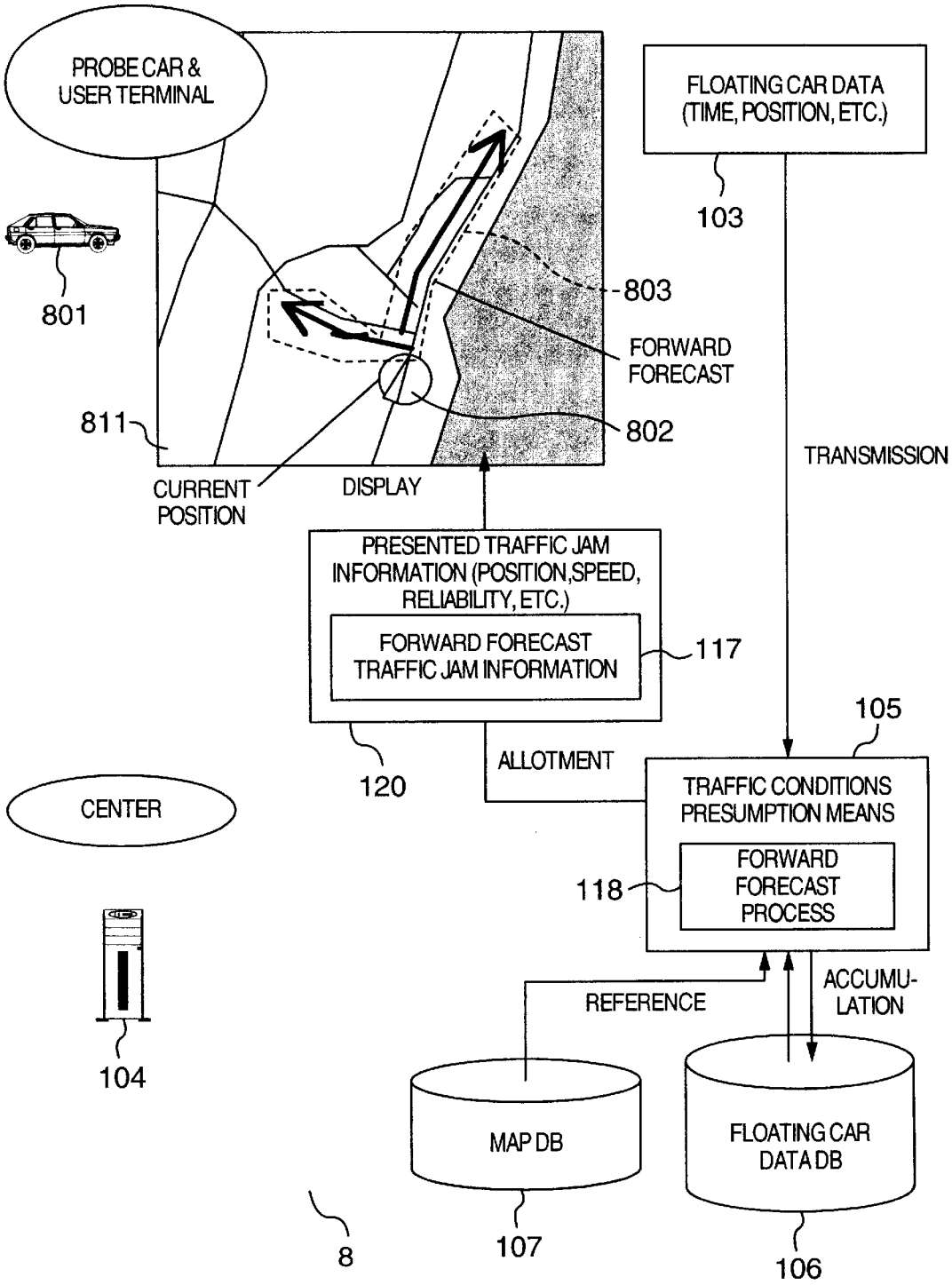
FIG. 8 is a second example of the system for presuming and presenting traffic conditions by using floating car data.

FIG. 8 is a second example of the system for presuming and presenting traffic conditions by using the floating car data of the present invention. This embodiment is an example in which a probe car 801 serves as the user terminal in addition to the probe car, and also is an example in which it has means for sending the floating car data to the center 104 and also receiving the presented traffic information 117. In a traffic information map 811, reference numeral 802 denotes the current position of the probe car, and reference numeral 803 denotes a forward forecast driving path of the probe car.

The probe car 801 gathers its own driving path as floating car data 103 on a real road network, and sends it to the center equipment 104. The center equipment 104 accumulates the received floating car data in the floating car data DB 106. Furthermore, the center equipment 104 refers to the floating car data DB 106 and the map DB 107 to create presented traffic jam information 117 by using the forward forecast process 118 in the traffic conditions presumption means 105. At this time, while the forward forecast process 118 creates the forward forecast traffic jam information 120 according to the flowchart in FIG. 4, it limits it to the forward of the probe car 801 when extracting the output route section in S402. It is possible, es-pecially in the case where the probe car set a destination and sent it to the center, to limit the section from the probe car's current position to the destination as the output route section. The probe car 801 acquires the presented traffic jam information 117 from the center equipment 104 to display the traffic information map 811. The traffic information map 811 is a representation of the traffic information of the presented traffic jam information 117.

As the probe car 801 allows the center, by using the system for presuming and presenting traffic conditions according to this embodiment, to limit the route requiring the traffic jam information by sending the floating car data so as to reduce the load of calculating the presented traffic jam information at once on the part of the center. At the same time, traffic of the presented traffic jam information is reduced, leading to a reduced communication load. In addition, a driver of the probe car 801 can now enjoy traffic jam information presentation services according to individual necessities.

[Example of Forecasting Traffic Jam Situation with On-Vehicle Terminal]

Figure 13:
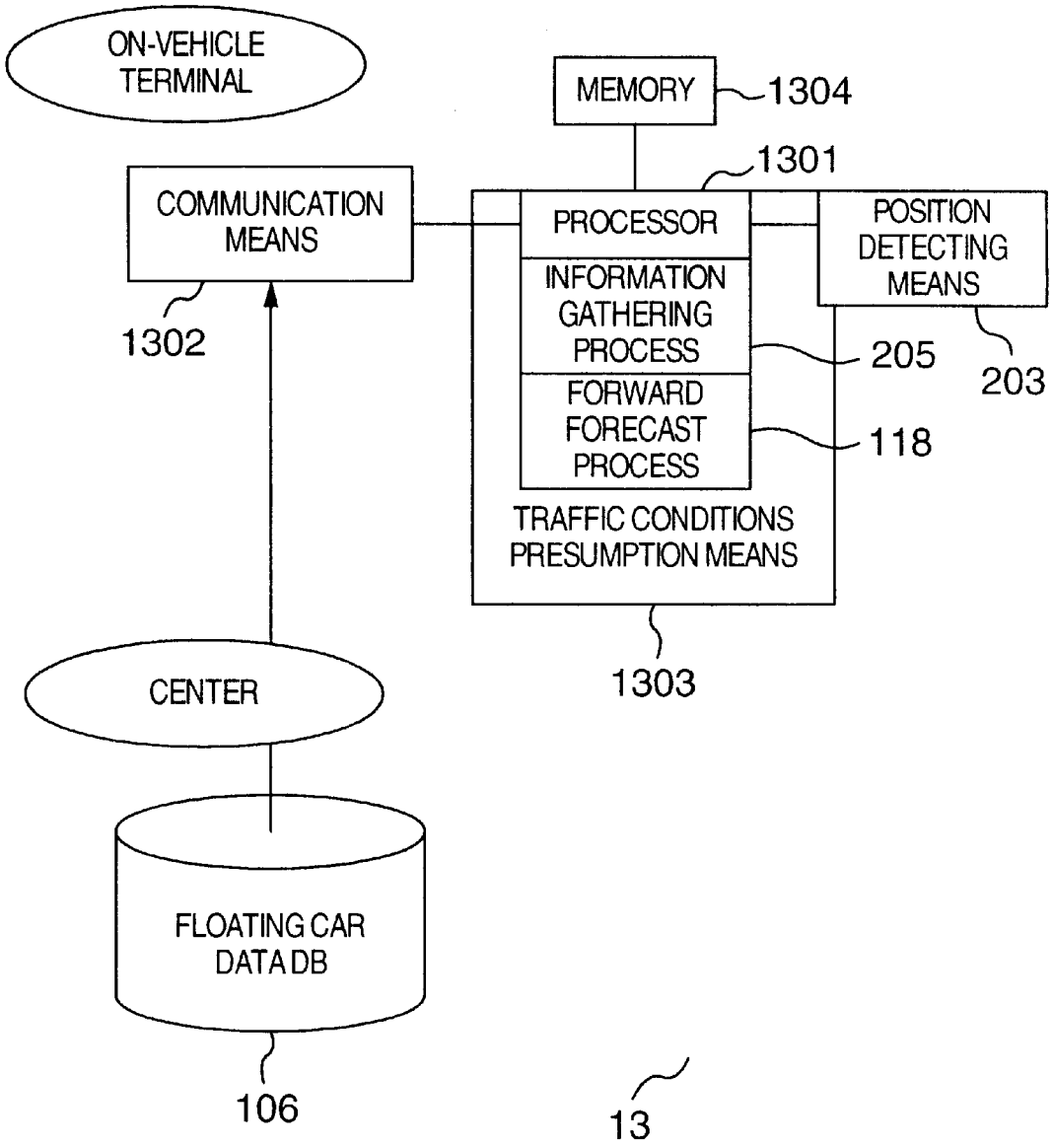
FIG. 13 is an example of an on-vehicle terminal and a traffic conditions presumption/gathering system having traffic conditions presumption means using the floating car data of the present invention.

FIG. 13 is an example of the on-vehicle terminal having the means for presuming traffic conditions by using floating car data of the present invention. This embodiment is characterized by performing the forward forecast process 118 with a processor 1301 of the on-vehicle terminal. The processor 1301 records by information gathering process 205 a position of the probe car measured by the position detecting means 203 as the floating car data together with time at every fixed cycle in a memory 1304. In addition, a communication means 1302 receives the floating car data DB 106 accumulated at the center as surrounding traffic conditions and registers it with the memory 1304. The processor 1301 forecasts the traffic jam situation forward of its own vehicle and presumes the traffic conditions by using the floating car data of its own vehicle recorded in the memory and the floating car data DB received from the center and using the forward forecast process 118. It is possible, by presenting the aforementioned traffic conditions to the driver, for the driver to enjoy traffic jam information presentation services of the area that his or her vehicle is going to travel.

While this embodiment assumes that the floating car data DB is used as the surrounding traffic conditions, it is possible to perform a forward forecast with an existing traffic information presentation system such as VICS (Vehicle Information and Communication System) by using the traffic conditions received by the on-vehicle terminal in the case where the surrounding traffic conditions in the memory 1304 is converted into a format as shown in FIG. 5. In addition, as for the communication means 1302 for receiving the surrounding traffic conditions, it is sufficient to be capable of radio communication such as broadcasting, small area communication or communication by a portable telephone. Moreover, especially in the case where a two-way communication function can be implemented, it becomes possible, by sending its own vehicle position, to limit the area of the surrounding traffic conditions and register the floating car data of its own vehicle with the floating car data DB 106.

[Example of Communication System for Transmitting Presented Traffic Jam Information]

Figure 14:
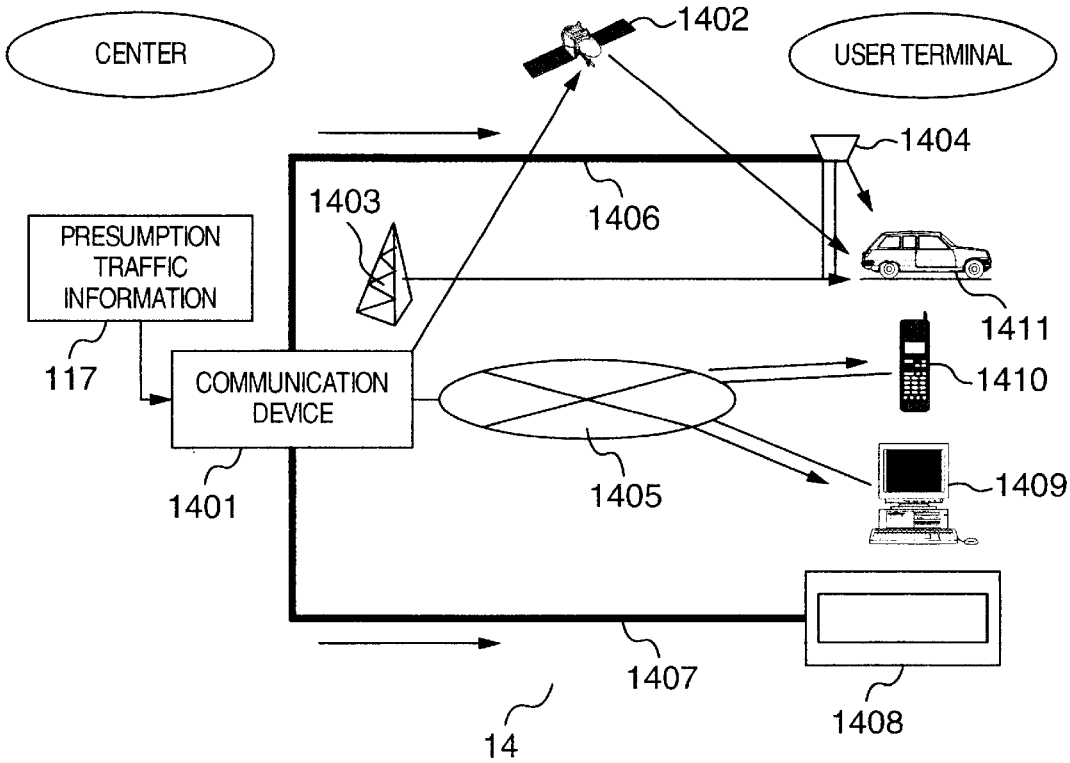
FIG. 14 is an example of a communication system transmitting presented traffic information created by a method of presuming traffic conditions of the present invention.

FIG. 14 is an example of a communication system for transmitting presented traffic information created by a method of presuming traffic conditions of the present invention. Reference numerals 1402 to 1407 denote the communication systems, where 1402 denotes a communication satellite such as HEO (hyperelliptic orbit satellite), 1403 denotes a broadcasting station, 1404 denotes a small area communication apparatus such as radio beacon, 1405 denotes the Internet network, and 1406 and 1407 denote communication lines such as a digital dedicated line. In addition, reference numerals 1408 to 1411 denote the user terminal and movable bodies on which the user terminal is mounted, where 1408 denotes a stationary display unit, 1409 denotes a personal computer connected to the Internet network, 1410 denotes a portable telephone capable of data communication and visual display, 1411 denotes a vehicle on which a PDA having communication means and a car navigation apparatus are mounted.

The presented traffic jam information 117 created by the aforementioned method of presuming traffic conditions allots the presented traffic information 117 to the user terminals 1408 to 1411 via a communication device 1401 and by way of the communication systems 1402 to 1407.

While this embodiment showed an example of sending the presented traffic information to the user terminals, it is also possible to use the communication systems shown in this embodiment as the floating car data DB or the communication system for sending the surrounding traffic conditions to the on-vehicle terminal in the embodiment shown in FIG. 13.

[Example of User Terminal]

Figure 15:
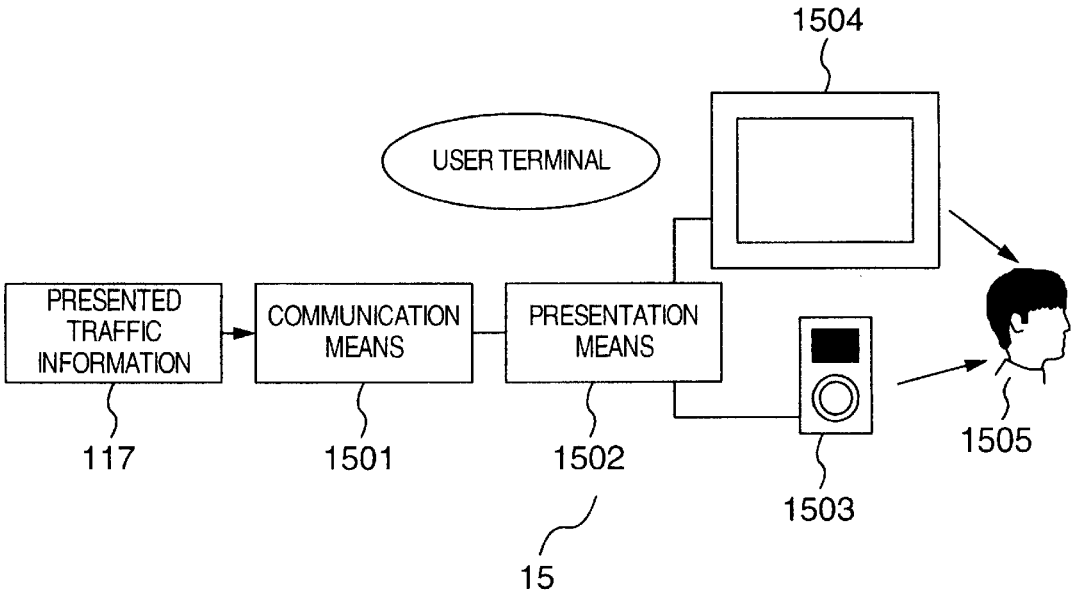
FIG. 15 is an example of a user terminal according to an embodiment of the present invention.

FIG. 15 is an example of the user terminal according to an embodiment of the present invention. 1503 is a speaker for outputting voice, 1504 is a display unit for outputting images and video. The presented traffic information sent via the communication systems in FIG. 14 is received by communication means 1501 and interpreted by presentation means 1502 to be presented to a user 1505 as representation by video, image and voice. As an example of representation of the presented traffic information, there is the method of displaying a map screen shown in FIG. 1 on the display unit 1504. In addition, there is a method of representing a message such as "A jam at about 500 m forward of the ○×intersection (calculated by a forecast)" displaying by voice with a speaker 1503 or representing it as characters on the display unit 1504.

What is claimed:

1. A method of presenting road maps which represent traffic jam situations ahead of a vehicle by using an on-vehicle terminal, on the basis of floating car data, comprising:

representing a road interval on which a probe car is driving with a first color in cases where the probe car is driving at a speed less than a first predetermined value, representing a road interval on which the probe car is driving with a second color in cases where the probe car is driving at a speed less than a second predetermined value, and representing other road intervals with a third color.

2. A method according to claim 1 and further including presuming traffic conditions by using floating car data obtained from a probe car to presume a traffic jam situation at locations from a location measured backwards to a location measured forward with respect to the probe car.

3. A method according to claim 2, and further including using sensors installed on a road to presume said traffic jam situation.

4. A method according to claim 1 and further including:

finding the reliability of a presumed traffic jam situation; and changing a method of representing on the basis of said reliability.

5. A method according to claim 4, comprising changing color density used in representing a presumed traffic jam situation depending on the reliability found.

6. A method according to claim 5, comprising making the color lighter in representing a presumed traffic jam situation depending on the reliability found.

7. A method according to claim 4, comprising causing the color used in representing a presumed traffic jam situation to flash depending on the reliability found.

8. A method of presenting road maps which represent traffic jam situations ahead of a vehicle by using an on-vehicle terminal, on the basis of floating car data, comprising:

finding the reliability of a presumed traffic jam situation; and changing the method of representing said presuming traffic jam situation on the basis of said reliability, said reliability being determined in accordance with the distance from the present location at each location of the forecast driving path of said vehicle.

9. A method according to claim 8, comprising changing color density used in representing a presumed traffic jam situation depending on the reliability found.

10. A method according to claim 9, comprising making the color lighter in representing a presumed traffic jam situation depending on the reliability found.

11. A method according to claim 8, comprising causing the color used in representing a presumed traffic jam situation to flash depending on the reliability found.

* * * * *